US006575415B1

(12) United States Patent
Williamson

(10) Patent No.: US 6,575,415 B1
(45) Date of Patent: Jun. 10, 2003

(54) STEM CLIP FOR HIGH INTENSITY DISCHARGE LAMP

(75) Inventor: Glen P. Williamson, Manchester, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/155,541

(22) Filed: May 24, 2002

(51) Int. Cl.[7] ..... E04G 3/00; H01J 1/02; H01J 61/52

(52) U.S. Cl. ..... 248/205.1; 248/316.1; 248/694; 313/25; 313/11; 313/17; 313/634; 313/416

(58) Field of Search ..... 313/25, 634, 11, 313/17, 416; 248/205.1, 316.1, 694

(56) References Cited

U.S. PATENT DOCUMENTS 4,146,814 A * 3/1979 Wojtowicz ..... 313/580
4,600,856 A * 7/1986 Bouchard et al. ..... 313/25
5,075,588 A * 12/1991 Hunter ..... 313/25
5,136,204 A * 8/1992 Muzeroll et al. ..... 313/25
5,212,422 A * 5/1993 Topel et al. ..... 313/318.01
5,250,872 A * 10/1993 Wakimizu et al. ..... 313/25
5,252,885 A * 10/1993 Muzeroll et al. ..... 313/25
5,270,608 A * 12/1993 Williamson et al. ..... 313/25
5,521,458 A * 5/1996 Kulik, Jr. ..... 313/25
5,528,107 A * 6/1996 Marlor et al. ..... 313/636
6,188,164 B1 * 2/2001 Brown et al. ..... 313/25
6,249,077 B1 * 6/2001 Brown et al. ..... 313/25
6,294,861 B1 * 9/2001 Mochiduki et al. .... 313/318.01

* cited by examiner

*Primary Examiner*—Kimberly Wood
(74) *Attorney, Agent, or Firm*—William E. Meyer

(57) ABSTRACT

A mount assembly (20) for a lamp has a glass stem (22) having a first portion (24) that is tubular and has an outside diameter D2 and a second portion (26) formed as a pinch seal with at least one dimension greater than D2. A substantial C-shaped clip (10) is mounted upon the first portion (24). The C-shaped clip (10) has a given height H and an inside diameter D that is smaller than the outside diameter D2 whereby the clip (10) frictionally engages the first portion (24). A pair of substantially oppositely located cutouts (12, 14) is formed in the clip (10), each providing an extending flap (16, 18) projecting away from the clip (10). The clip is positioned on the first portion (24) such that at least a part of said second portion (26) is contained within the cutouts (12, 14). A first frame member (28) is affixed to the flap (16) and a second frame member (28) is affixed to the flap (18). This assembly accurate supports the structure and prevents rotation of the mount assembly.

3 Claims, 1 Drawing Sheet

STEM CLIP FOR HIGH INTENSITY DISCHARGE LAMP

TECHNICAL FIELD

This invention relates to lamps and more particularly to mount assemblies for arc discharge lamps. Still more particularly it relates to mount assemblies that are economical to fabricate, suitable for automation, and mounted so as to resist rotation.

BACKGROUND ART

Mount assemblies for arc discharge lamps usually employ a discharge vessel mounted upon a frame. The frame is generally mounted directly to in-leads projecting from a flare. The flare itself comprises a tubular body that can carry the exhaust tubulation and seals the in-leads in a pinch seal. Previous assemblies have employed formed, soft nickel straps that were welded to one leg of a frame, curled manually, welded to a second leg of the frame, placed around the barrel portion of the flare, grasped with pliers and welded together. Further forming conformed the strap to the profile of the flare barrel. Such assemblies are expensive and require a great deal of manual operations to complete. The repetitious hand operations also had unacceptable ergonomic issues.

DISCLOSURE OF INVENTION

It is, therefore, an object of the invention to obviate the disadvantages of the prior art.

It is another object of the invention to enhance the assembly of arc discharge lamps.

It is yet another object of the invention to provide a mount assembly that is suitable for automated construction.

These objects are accomplished, in one aspect of the invention, by the provision of a substantially C-shaped clip formed from spring steel. The clip has a given height H and an inside diameter D. A pair of substantially oppositely located cutouts, each providing an extending flap, project away from the clip.

Additionally, there is provided a mount assembly for a lamp that comprises a glass stem having a first portion that is tubular and has an outside diameter D2 and a second portion formed as a pinch seal having at least one dimension greater than D2. Generally, the pinch seal is more or less rectangular in cross-section. A substantially C-shaped clip is mounted upon the first portion. The C-shaped clip has a given height H and an inside diameter D that is smaller than the outside diameter D2 whereby the clip frictionally engages the first portion. A pair of substantially oppositely located cutouts is formed in the clip, each providing an extending flap that projects away from the clip. The clip is positioned on the first portion such that at least a part of the second portion is contained within the cutouts. A first frame member is affixed to one flap and a second frame member is affixed to the other flap.

This structure provides a unit that can assembled by automation techniques, thus providing a more efficient, cost effective structure. Further, the frame-clip unit attaches easily to the glass flare and when mounted is rotationally fixed by virtue of the cutout portions engaging a portion of the pinch seal. Additionally, ergonomic issues associated with the prior technique are reduced.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
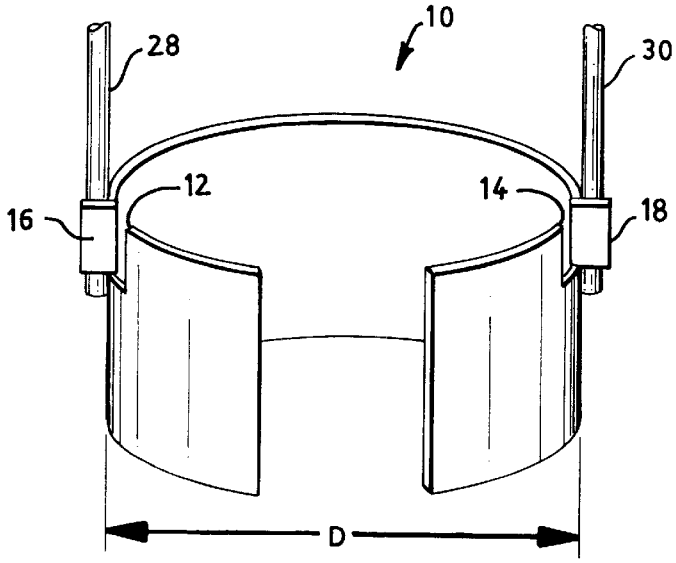
FIG. 1 is a perspective view of an embodiment of the invention.

Referring now to the drawings with greater particularity, there is shown in FIG. 1 a substantially C-shaped clip 10 formed from spring steel. The clip 10 has a given height H and an inside diameter D that is smaller than the diameter of the flare with which it is to be employed. The clip 10 has a pair of substantially oppositely located cutouts 12, 14, each providing an extending flap 16, 18 projecting away from the clip. Preferably, the flaps extend away from the clip at an angle of 90°.

The clip is utilized in a mounting assembly 20 for a lamp. The mounting assembly 20 comprises a glass stem or flare 22 that has a first portion 24 that is tubular and has an outside diameter D2 and a second portion 26 formed as a pinch seal having at least one dimension greater than D2.

The substantially C-shaped clip 10 is mounted upon the first portion 24. The given height H of the clip is less than the height of the tubular portion 24 and the inside diameter D is smaller than the outside diameter D2 whereby the clip 10 frictionally engages the first portion 24.

Figure 2:
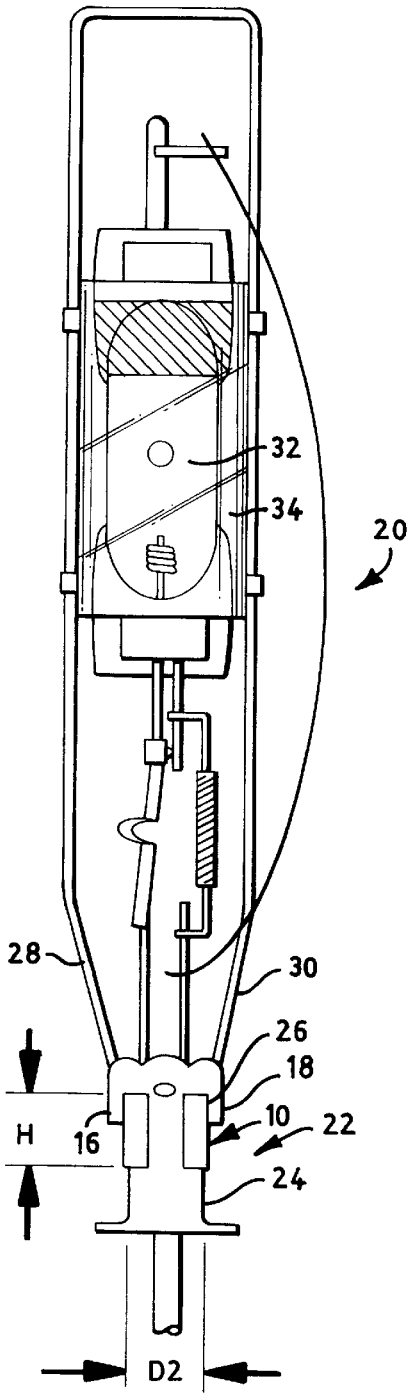
FIG. 2 is an elevational view of an embodiment of the invention mounted upon a glass flare.

The pair of substantially oppositely located cutouts 12, 14 formed in the clip 10 engage at least a part of the second portion 26, i.e., the pinch seal, of the flare, as seen in FIG. 2.

A first frame member 28 is affixed to the flap 16 and a second frame member 30 is affixed to flap 18. Affixation can be by any suitable technique, such as welding which is preferred The mount comprising the clip and the frame is assembled to the flare by aligning the opening in the clip 10 in the longitudinal direction of the pinch seal, attaching the clip to the barrel of the flare, rotating the clip 90°, and then raising the clip until the cutouts 12 and 14 engage the bottom of the pinch seal, thereby preventing further rotation of the clip.

Figure 3:
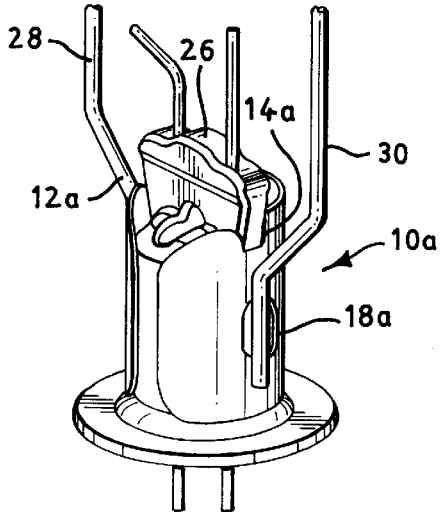
FIG. 3 is a perspective view of an alternate embodiment of the invention.

An alternate embodiment is shown in FIG. 3 wherein a clip 10*a* has cutouts 12*a* and 14*a* formed separately from the flaps, only one of which, 18*a,* is shown in FIG. 3.

The remainder of the lamp components, such as the arc tube 32 and a shield 34 can be attached to the frame either before or after the mount assembly is attached to the flare, and then the final connections of the electrical leads can be made.

There is thus provided a simple, cost effective, and ergonomically sensitive mount assembly for a lamp. It is relatively easy to automate the assembly, thereby reducing the previous hand operations.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A mount assembly for a lamp comprising:

a glass stem having a first portion that is tubular and has an outside diameter D2 and a second portion formed as a pinch seal having at least one dimension greater than D2;

a substantially C-shaped clip mounted upon said first portion, said C-shaped clip having a given height H and an inside diameter D that is smaller than said outside diameter D2 whereby said clip frictionally engages said first portion;

a pair of substantially oppositely located cutouts formed in said clip, each providing an extending flap projecting away from said clip, said clip being positioned on said first portion such that at least a part of said second portion is contained within said cutouts; and a first frame member affixed to a first of said flaps and a second frame member affixed to a second of said flaps.

2. The assembly of claim 1 wherein said C-shaped clip is formed from spring steel.

3. The assembly of claim 2 wherein said flaps project away from said clip at an angle of substantially 90°.

* * * * *